US006264884B1

(12) United States Patent
Grosse et al.

(10) Patent No.: US 6,264,884 B1
(45) Date of Patent: Jul. 24, 2001

(54) PURIFICATION HEARTH

(75) Inventors: Ingo A. Grosse, Richland, WA (US); Leonard C. Hainz, II, Albany, OR (US)

(73) Assignee: ATI Properties, Inc., Los Angeles, CA (US)

( * ) Notice: Subject to any disclaimer, the term of this patent is extended or adjusted under 35 U.S.C. 154(b) by 0 days.

(21) Appl. No.: 09/389,543

(22) Filed: Sep. 3, 1999

(51) Int. Cl.[7] ..... C22B 9/16
(52) U.S. Cl. ..... 266/241; 266/275
(58) Field of Search ..... 266/275, 241

(56) References Cited

U.S. PATENT DOCUMENTS

| | | | |
|---|---|---|---|
| Re. 32,932 | 5/1989 | Harker et al. | 164/506 |
| 3,343,828 | 9/1967 | Hunt | 219/121.16 |
| 4,027,722 | 6/1977 | Hunt | 164/469 |
| 4,190,404 | 2/1980 | Drs et al. . | |
| 4,372,542 | 2/1983 | Chia . | |
| 4,750,542 | 6/1988 | Harker et al. | 164/506 |
| 4,823,358 | 4/1989 | Aguirre et al. | 373/10 |
| 4,838,340 | 6/1989 | Entrekin et al. . | |
| 4,839,904 | 6/1989 | Harberts et al. . | |
| 4,932,635 | 6/1990 | Harker | 266/200 |
| 4,936,375 | 6/1990 | Harker | 164/469 |
| 4,961,776 | 10/1990 | Harker | 75/10.19 |
| 5,040,773 | 8/1991 | Hackman | 266/87 |
| 5,084,090 | 1/1992 | Harker . | |
| 5,171,357 | 12/1992 | Aguirre et al. . | |
| 5,171,358 | 12/1992 | Mourer | 75/10.19 |
| 5,222,547 | 6/1993 | Harker | 164/506 |
| 5,263,689 | 11/1993 | Menzies et al. | 266/80 |
| 5,291,940 | 3/1994 | Borofka et al. | 164/494 |
| 5,454,424 | 10/1995 | Mori et al. . | |
| 5,503,655 | 4/1996 | Joseph | 75/621 |
| 5,516,081 * | 5/1996 | Mourer | 266/233 |
| 5,972,282 * | 10/1999 | Aguirre et al. | 266/208 |

FOREIGN PATENT DOCUMENTS

| | | |
|---|---|---|
| 0 124 667 | 11/1984 | (EP) . |
| 2207225 | 1/1989 | (GB) . |
| WO 90/00627 | 1/1990 | (WO) . |

OTHER PUBLICATIONS

Patent Abstracts of Japan, publication No. 63273555, published Oct. 11, 1988, Applications No. 62106235, application date Jan. 5, 1987.

* cited by examiner

*Primary Examiner*—Roy King
*Assistant Examiner*—Tima McGuthry-Banks
(74) *Attorney, Agent, or Firm*—P. J. Viccaro

(57) ABSTRACT

A refining hearth. The refining hearth comprises an open vessel defining a first deep zone having a predetermined depth, a second deep zone having a predetermined depth, and a shallow zone intermediate the first deep zone and the second deep zone, wherein the shallow zone has a predetermined depth less that of the first deep zone and less than that of the second deep zone. A furnace for refining metal is also disclosed which employs a similarly constructed hearth. A method of refining metal is also disclosed. The method includes depositing molten metal in a first deep pool, passing the molten metal through a shallow pool having a depth less than the depth of the first deep pool, directing an energy source at the molten metal, and passing the molten metal into a second deep pool having a depth greater than the depth of the shallow pool.

41 Claims, 5 Drawing Sheets

PURIFICATION HEARTH

CROSS-REFERENCE TO RELATED APPLICATIONS

Not Applicable.

FEDERALLY SPONSORED RESEARCH

Not Applicable.

BACKGROUND OF THE INVENTION

1. Field of the Invention

The present invention relates to purification hearths and, more particularly, to a hearth for refining metals such as titanium by removing high and low density inclusions therefrom.

2. Description of the Invention Background

A variety of different processes and apparatuses have been developed for obtaining relatively pure metals or alloys by separating the slag and burning off or evaporating volatile impurities from the molten metal material. One such apparatus that has been developed to accomplish those tasks is a furnace having an energy source, such as an electron beam gun or a plasma torch, directed toward the surface of the metal in the furnace. Such a furnace, in general, comprises a vacuum chamber with a hearth and crucible system on the floor of the furnace and a number of energy sources mounted above the hearth. The energy sources are used to melt metals introduced onto the hearth and, through sublimation, evaporation and dissolution, remove certain impurities from the molten metal. Additionally, currents created by thermal gradations in the molten metal stream promote inclusion removal. When electron beam sources are utilized, each electron beam can be deflected and scanned over the surfaces of the metal being melted in the hearth. Thereafter, the liquid metal flows from the hearth into the crucible. Energy sources are utilized to maintain the metal in its liquid form as it flows through the hearth to the crucible.

Impurities or inclusions, generally exist within metallic raw materials and can remain within the metal if they are not removed by a refinement process. Those inclusions create areas of potential failure within the metal, and are detrimental in critical applications, such as rotating parts in jet engines. It is important, therefore, when creating high quality metals, that impurities be removed from or dissolved within the metal.

The impurities are generally removed while the metal is in a molten state, when the impurities having varying densities may be removed by settlement or floatation mechanisms. Impurities having a greater density than the metal naturally settle out in the hearth. In a typical process, however, the lower density or neutral density inclusions can be carried into the crucible mold because the lower density or neutral density inclusions are not removed when the metal is poured from the top of a typical hearth.

It is desirable in certain applications for impurities or inclusions that do not settle in the hearth to be sublimated, evaporated or dissolved into the liquid metal to prevent inclusions from forming defects within the solidified metal and thereby creating points of potential failure.

In addition, splatter is created when heat from the energy source impinges on volatile elements within the metal. When splatter occurs, matter, including impurities in the molten stream, can be propelled upward from the surface of the molten stream and outward in all directions. Some of that splatter, therefore, is propelled toward or into the crucible, thereby bypassing at least a portion of the refining process. Thus, it is desirable to reduce or eliminate spattering of the molten stream to prevent such material from by passing the refining process.

Accordingly, a need exists for methods and apparatuses for breaking up inclusions in a stream of molten metal to aid in the removal of impurities from the metal and dissolution of any remaining impurities in the metal.

A need also exists for apparatuses and methods for removing impurities from molten metal, wherein those impurities have a density less than or approximately equal to that of the metal being processed.

There is a further need for apparatuses and methods for preventing matter in a molten metal stream from bypassing further steps in a refining process.

There is still another need for an apparatus having the above-mentioned advantages that is relatively inexpensive to manufacture and install.

SUMMARY OF THE INVENTION

In accordance with a particularly preferred form of the present invention, there is provided a refining hearth. The refining hearth comprises an open vessel defining a first deep zone having a predetermined depth, a second deep zone having a predetermined depth, and a shallow zone intermediate the first deep zone and the second deep zone. The shallow zone, furthermore, has a predetermined depth less than that of the first deep zone and less than that of the second deep zone.

A furnace for refining metal is also provided. The furnace comprises a refining hearth defining a first deep zone having a depth, a second deep zone having a depth and a shallow zone having a depth that is less than the depth of the first deep zone and the depth of the second deep zone and at least one energy source mounted above the hearth.

A method of refining metal is also disclosed. The method includes depositing molten metal in a first deep pool, passing the molten metal through a shallow pool having a depth less than the depth of the first deep pool, directing an energy source at the molten metal, and passing the molten metal into a second deep pool having a depth greater than the depth of the shallow pool, while directing an energy source at the molten metal.

Another method of refining metal, comprises melting raw material containing a desired metal to form a molten stream, applying energy to the surface of the molten stream, trapping impurities having a higher density than the metal, and creating turbulence in the molten stream.

It is a feature of the present invention to provide a series of hearths for refining and purifying metal.

It is another feature of the present invention to provide a hearth having sections of varying depths oriented in series. Such a multilevel structure removes undesirable inclusions by trapping certain of those inclusions in the deeper sections and by forcing other of those inclusions nearer the surface of the metal in the more shallow sections where the inclusions and impurities may be removed by sublimation, evaporation or dissolution by exposing them to high thermal energy.

Yet another feature of the present invention is to provide a series of pools separated by offset narrow shallow flow notches. That configuration causes the molten metal to flow along a non-linear path which circulates impurities through the molten stream, thereby exposing the impurities to high thermal energy.

Another feature of the present invention is the use of multiple hearths in series. The hearths are configured such that molten metal is discharged from a pour lip of the discharging hearth and cascades into the receiving hearth. Thus, the inclusions are broken up and the molten stream is mixed by the turbulence caused by the molten stream cascading from the pour lip.

It is another feature of the present invention that barrier walls are placed above the molten stream to prevent splattered materials from bypassing the purification system.

Accordingly, the present invention provides solutions to the shortcomings of prior hearths. Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

It is to be understood that the Figures and descriptions of the present invention included herein illustrate and describe elements that are of particular relevance to the present invention, while eliminating, for purposes of clarity, other elements found in a typical metal manufacturing process. Because the construction and implementation of such other elements are well known in the art, and because a discussion of them would not facilitate a better understanding of the present invention, discussion of those elements is not provided herein. It is also to be understood that the embodiments of the present invention that are described herein are illustrative only and are not exhaustive of the manners of embodying the present invention. For example, it will be recognized by those skilled in the art that the present invention may be readily adapted to function with titanium processing, as well as processing other metals and materials that require refinement in a manner similar to that of titanium. It will also be recognized that the refining hearths and barriers of the present invention may be utilized alone or in various combinations with equipment discussed herein and with other equipment not discussed herein.

Figure 1:
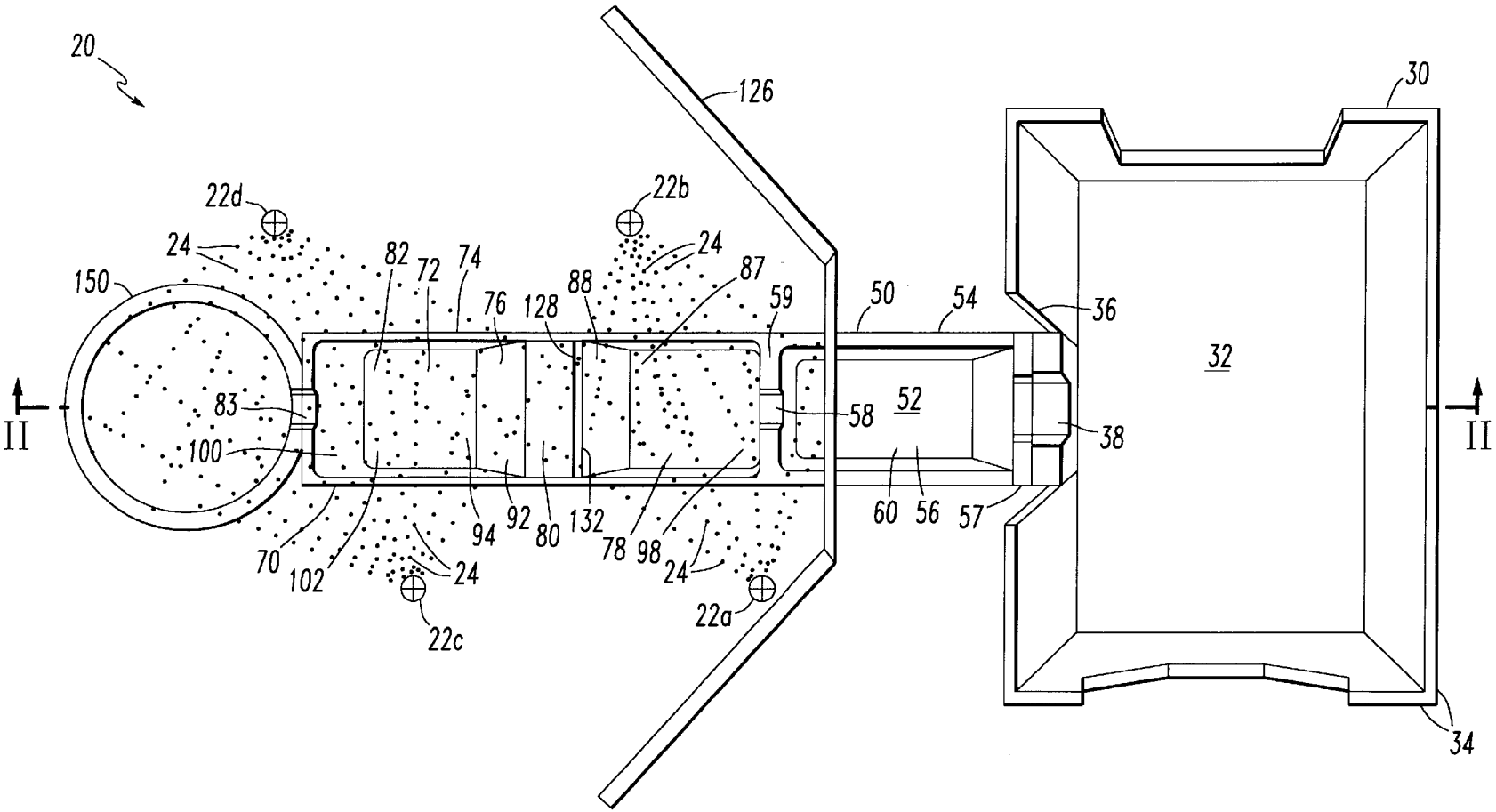
FIG. 1 is a top view of a molten metal refining apparatus of the present invention.
Figure 2:
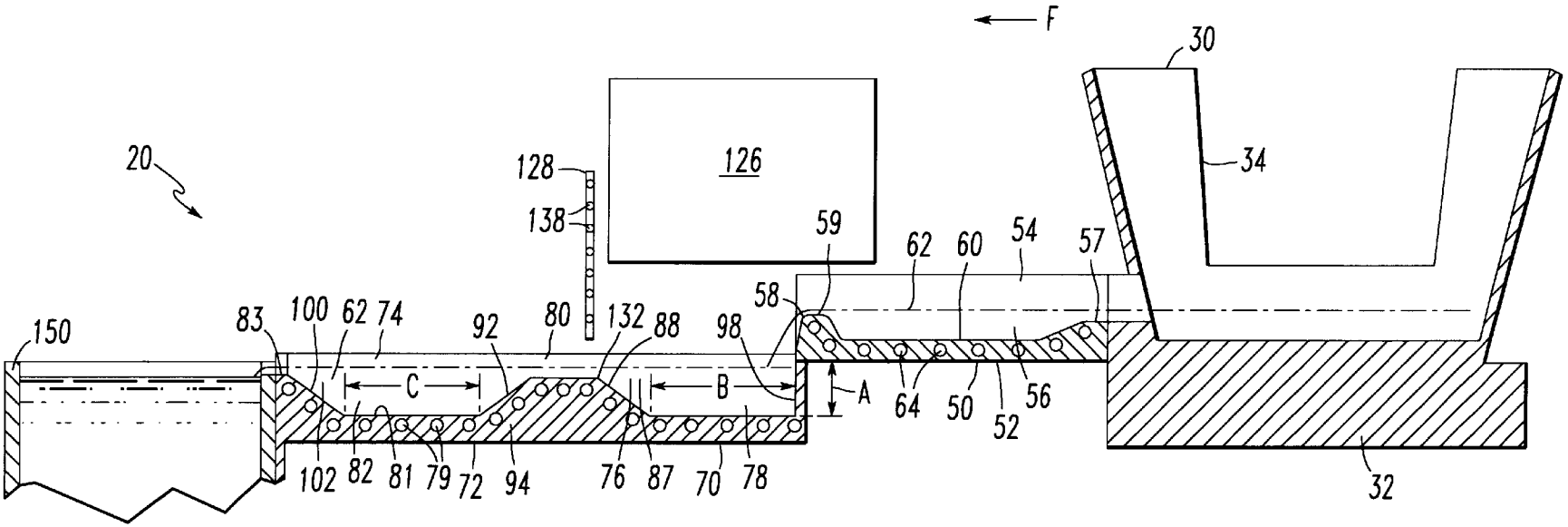
FIG. 2 is a cross-sectional view of the molten metal refining apparatus of FIG. 1 containing a molten stream, taken along line II—II in FIG. 1.

Referring now to the drawings for the purposes of illustrating the present preferred embodiments of the invention only and not for the purposes of limiting the same, FIG. 1 is a top view of a series of hearths configured to form a hearth system 20 for processing raw material into purified metal and, in particular, for creating premium grade titanium. FIG. 2 is a cross-sectional view of the hearth system 20 depicted in FIG. 1. The apparatus of FIGS. 1 and 2 comprises an embodiment of the invention that includes a main hearth 30, a transfer hearth 50, a refining hearth 70, and a crucible 150. Those skilled in the art will recognize that each of those components 30, 50, 70, and 150 may be used in the configuration depicted in varying combinations. In the embodiment illustrated in FIGS. 1 and 2, raw material containing titanium or another desired material, is introduced into the main hearth 30 utilizing conventional loading apparatuses and methods. The main hearth 30 includes a base 32 and side walls 34 defining a melt area and an opening 36 through which liquefied metal may pass. The raw materials are heated within the main hearth 30 by one or more energy sources such as, for example, electron beam gun 22 or plasma torches oriented above the base 32. As the raw material is heated within the main hearth 30, it forms a stream of molten metal 62 which flows from the main hearth 30 in the direction represented by arrow "F" in FIG. 2. The opening 36 may be raised from the base 32 of the main hearth 30 to prevent unmelted raw material and impurities having a density greater than the metal from escaping the main hearth 30. The opening 36 may also be narrow to minimize the amount of material escaping the main hearth 30 by way of splattering. A channel 38 may furthermore be formed at the opening 36 to direct the flow of the molten metal 62 into the transfer hearth 50.

The transfer hearth 50 includes a base 52 and an upstanding wall 54 defining a pool 56, an inlet 57, and an outlet 59. The transfer hearth 50 may be fabricated from copper and as illustrated in FIG. 2, may include coolant passages 64 through which a coolant, such as water, flows. It will be understood that coolant prevents the transfer hearth 50 from being damaged by the molten metal and results in the formation of a "skull" (not shown) of hardened metal on the surface 60 of the transfer hearth 50. In operation, impurities are removed from the molten metal 62 as the metal flows through the transfer hearth 50. Impurities having a density greater than the metal, sink to the bottom of the pool 56 and are captured at the liquid metal interface with the solidified portion of the skull. Energy sources, such as conventional electron beam guns 22 illustrated in FIG. 1, are aimed at the surface of the skull, providing a molten metal surface 62, thereby sublimating, evaporating or dissolving impurities near the surface of the molten metallic stream 62.

Figure 3:
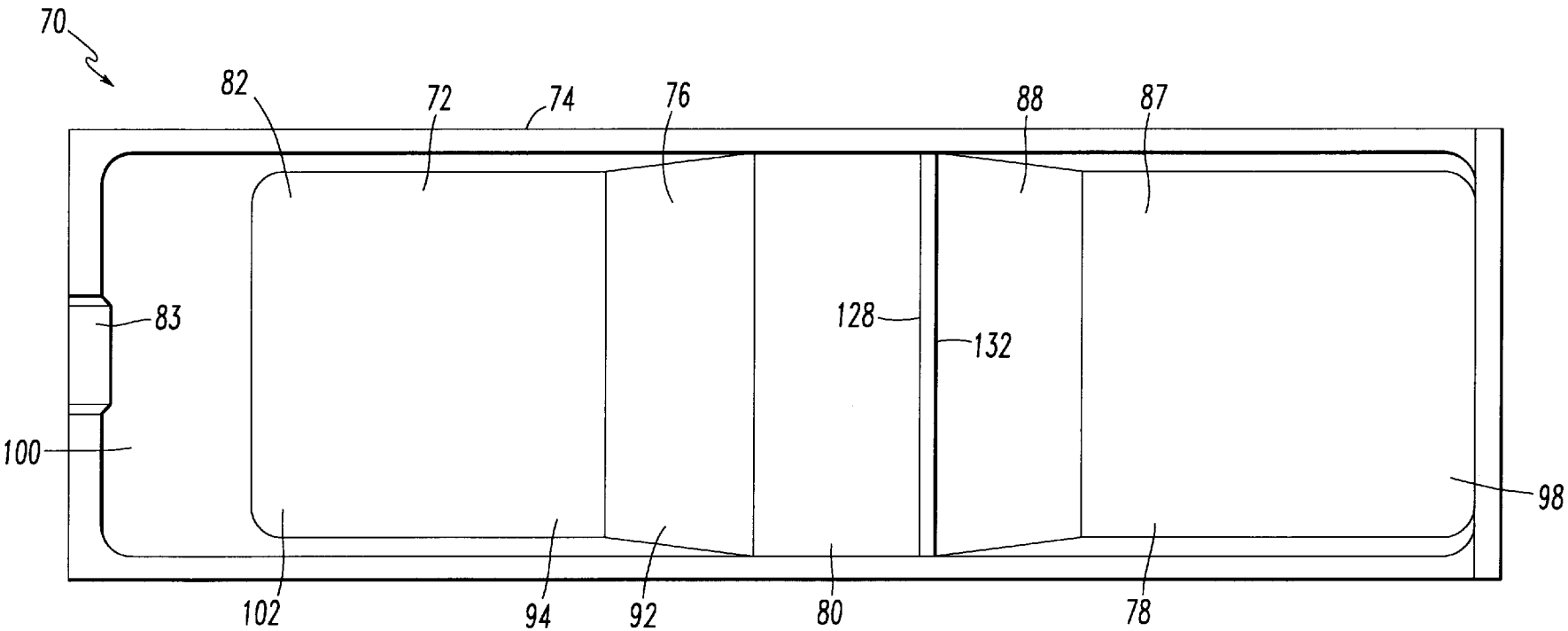
FIG. 3 is a top view of the refining hearth of FIG. 1.

FIG. 3 illustrates a refining hearth 70 into which the molten metal stream 62 flows from the transfer hearth 50. The refining hearth 70 includes a base 72 surrounded by an upstanding wall 74 defining a pool 76. In the embodiment illustrated in FIGS. 1–3, the pool 76 is divided into a first deep zone 78, a shallow zone 80, and a second deep zone 82. As can be seen in FIG. 2, the shallow zone 80 is centrally disposed between the first deep zone 78 and the second deep zone 82. That embodiment also includes a raised lip 83 over which the refined metal 62 flows when exiting the refining hearth 70. As illustrated in FIG. 2, the refining hearth 70 may also be fabricated from copper and may include coolant passages 79 through which a coolant, such as water, flows. The coolant prevents the refining hearth 70 from being damaged by the molten metal 62 and results in the formation of another skull (not shown) of hardened metal on the surface 81 of the refining hearth 70.

As the raw materials are heated within the main hearth 30, a stream of molten metal 62 is formed which flows into the transfer hearth 50 wherein it is further heated. Such molten stream 62 exits the transfer hearth 50 through the outlet 59 and flows over a raised lip 58 that extends up from the base 52 of the transfer hearth 50. As may be seen in FIG. 2, as the molten stream 62 flows over the raised lip 58 of the transfer hearth 50, it cascades into the refining hearth 70. The refining hearth 70 is positioned such that the upper surface of the molten stream 62 in the refining hearth 70 is beneath the raised lip 58. A drop of approximately 6" from the raised lip 58 of the transfer hearth 50 to the base 72 of the refining hearth 70 has been found to impart a desirable amount of turbulence to the molten stream 62 as it enters the first deep zone 78 of the refining hearth 70. As may be seen in FIG. 1, a conventional high powered electron beam gun 22*a*, may be directed toward the thin molten stream 62 flowing over the raised lip 58 and cascading from the transfer hearth 50, to remove inclusions remaining in the stream. The molten stream 62 is beneficially mixed, as it enters the refining hearth 70, by the turbulence caused by the molten stream 62 cascading from the raised lip 58 into the refining hearth 70, and by thermal stirring caused by the higher temperature imparted on the cascading stream by the electron beam gun 22*a*. The mixing of the molten stream 62 within the refining hearth 70 breaks up inclusions and causes the dispersed impurities to move to the surface of the swirling molten stream 62 from time to time. Additional impurities may therefore be sublimated, evaporated or dissolved by a heat source such as the electron beam gun 22*a*, which is aimed at the surface of the molten stream 62 where it enters the refining hearth 70.

The multilevel structure of the refining hearth 70 further aids in breaking up inclusions and removing undesirable impurities in the hearth system 20. High density inclusions and impurities that may have advanced from the transfer hearth 50 into the refining hearth 70 settle out of the stream as the turbulence subsides and become trapped in the skull (not shown) of hardened material that forms along the bottom of the refining hearth 70 due to the contact of the molten stream 62 with the cooled surface 81 of the hearth 70. Therefore, the deep zones 78 and 82 should be of a depth sufficient to trap high density impurities, thereby preventing those impurities from passing out of the deep zones 78 and 82. For example, it has been found that a deep zone depth of approximately 4" (i.e., distance "A" as shown in FIG. 2) is sufficient to prevent most high density inclusions from passing out of the deep zones 78 or 82 at a flow rate of 2 fpm or less. It is also beneficial for each deep zone 78 and 82 to be of a sufficient length to allow the turbulence that exists at the upstream end 98 of the first deep zone 78 and the upstream end 94 of the second deep zone 82 to subside prior to leaving that zone 78 or 82. That permits high density inclusions to settle to the bottom of the molten stream 62, thereby permitting those high density inclusions to be trapped in the skull (not shown) at the surface 81 of the refining hearth 70. For example, it has been found that a deep zone 78 having a length of from 20–30" (represented by arrow "B" in FIG. 2) permits high density inclusions (i.e., inclusions having a density greater than the metal being refined) to settle to the bottom thereof. Likewise, a deep zone 82 having a length of from 20–30" (represented by arrow "C" in FIG. 2) results in dissolution of inclusions having similar densities. The widths of the deep zones 78 and 82 are chosen to create the desired flow rates through the deep zones 78 and 82. For example, it has been found that the flow rate in a deep zone having a width of 21" and receiving molten stream 62 at a rate of 1.6 gpm, is 1 fpm. It has furthermore been discovered through experimentation that a flow rate of 1–2 fpm provides for good throughput of molten stream 62 while also providing sufficient opportunity for the removal of impurities to create acceptable quantities of high grade metal. This unique aspect of the present invention represents an improvement over prior hearth designs in that the refinement hearth reduces the molten metal dwell time required and throughout is accordingly increased. It will be appreciated, however, that deep zones of other lengths and widths may also be successfully employed without departing from the spirit and scope of the present invention and also that flow rates of lower and higher rates than indicated as examples would result in impurity removal.

Impurities having a density less than that of the metal rise to the surface of the molten stream 62 as the turbulence subsides in the downstream portions 87 and 102 of the deep zones 78 and 82, respectively. Those low density impurities may, therefore, be removed from the surface of the stream by electron beam guns 22 or other energy sources directed at the surface of the stream which can result in their sublimation, evaporation or dissolution.

In the shallow zone 80, the molten stream 62 forms a shallow pool (i.e., approximately 1–1.5"deep). Thus all impurities, including those having a neutral density, are forced to move to or near the surface of the metal stream 62 in the shallow zone 80. The impurities may, therefore, be sublimated, evaporated or dissolved by an energy source such as the depicted conventional electron beam gun 22*b* which is directed at the surface of the molten stream 62. In the embodiment illustrated in FIGS. 1–3, the shallow zone 80 extends the full width of the refining hearth 70 to minimize the increased velocity of the molten stream 62 caused by the reduction in the depth of the stream. The shallow zone 80 also extends lengthwise along the refining hearth 70 for a distance sufficient to create a large shallow area to provide a dwell time for the impurities as they pass through the shallow zone 80, during which the turbulence induced by the energy source in the shallow zone exposes the impurities to high energy, insuring their removal by sublimation, evaporation or dissolution. For example, a shallow zone 80 that is 6–12" long will remove a substantial quantity of impurities. In such a shallow zone 80, The electron beam gun 22*b* is able to apply energy at a high level to the molten stream 62 for more effective impurity removal.

As can be seen in FIG. 2, the refining hearth 70 may include a sloping surface 88 that extends from the bottom of the deep zone 78 to the shallow zone 80 to facilitate transfer of the molten metal 62 to the shallow zone 80. It has been found that such a sloping surface 88 creates a turbulence in the molten stream 62 passing through the shallow zone 80 which, once again, causes impurities to circulate and periodically approach the surface of the molten stream 62 as it passes through the shallow zone 80. The sloping surface 88 is also beneficial when it comes time to clean and remove the skull from the hearth in that, when the metal solidifies, it will shrink and pull away from the refining hearth 70 and may then be easily removed without damaging the hearth 70.

To facilitate transition of the molten stream 62 from the shallow zone 80 to the second deep zone 82, a sloping surface 92 may also be provided therebetween as illustrated in FIG. 2. The downstream sloping surface 92 creates a desirable amount of turbulence in the entering end 94 of the second deep zone 82 and facilitates easy removal of the skull as discussed above. A sloping surface (not illustrated) may also be provided on the upstream side 98 of the first deep zone 78 and a sloping surface 100 may be provided on the downstream side 102 of the second deep zone 82 to control turbulence and prevent damage to the refining hearth 70. The second deep zone 82 is disposed downstream of the shallow zone 80 and is utilized in a manner similar to the first deep zone 78. Additional shallow and deep zones may be formed in the refinement hearth 70 to further refine the molten stream 62 if desired.

The molten stream 62 flowing through the transfer hearth 70 illustrated in FIGS. 1–3 passes out of the transfer hearth 70 through the transfer hearth's raised lip 83 and into a crucible 150 or other container for further processing Splatter of material in the molten stream 62 may occur for many reasons, including the impingement of an energy beam on volatile elements in the molten stream 62. The high temperature imparted on the volatile elements by the energy beam causes those elements to evolve into a gas which propels the elements and other nearby elements out of the molten stream 62. Splatter that is directed downstream in the hearth system 20 detrimentally bypasses part or all of the purification process, thereby reducing the quality of the refined metal.

To prevent splatter form being propelled downstream in the hearth system 20, one or more barrier walls 126, 128 and 130 may be placed between or along the hearths 30, 50 and 70 as partitions. Each barrier wall 126, 128 and 130 may be fabricated from copper and may include coolant passages 138 through which coolant flows to prevent the barrier walls 126, 128 and 130 from being damaged by the high temperature of the hearth system 20 and the splattering particles. The barrier walls 126, 128 and 130 should extend upward from above the molten stream 62, and should extend at least across the width of the molten stream 62. For example, a barrier wall 126, 128 and 130 that extends from approximately 2" above the surface of the stream to 132" above the stream, and extends across the width of the hearth 50 or 70 has been found to effectively block splattering material directed downstream. However, other barrier orientations could conceivably be employed. Barrier walls 126, 128 and 130 may be placed anywhere along the path of the molten stream 62. In particular, it has been found to be beneficial to place a barrier wall 126 downstream of the main hearth 30 and place other barrier walls 128 and 130 at the upper entering edge 132 of the shallow zone 80 and the upper entering edge 134 and 136 of each flow notch 106 and 108 respectively.

Figure 4:
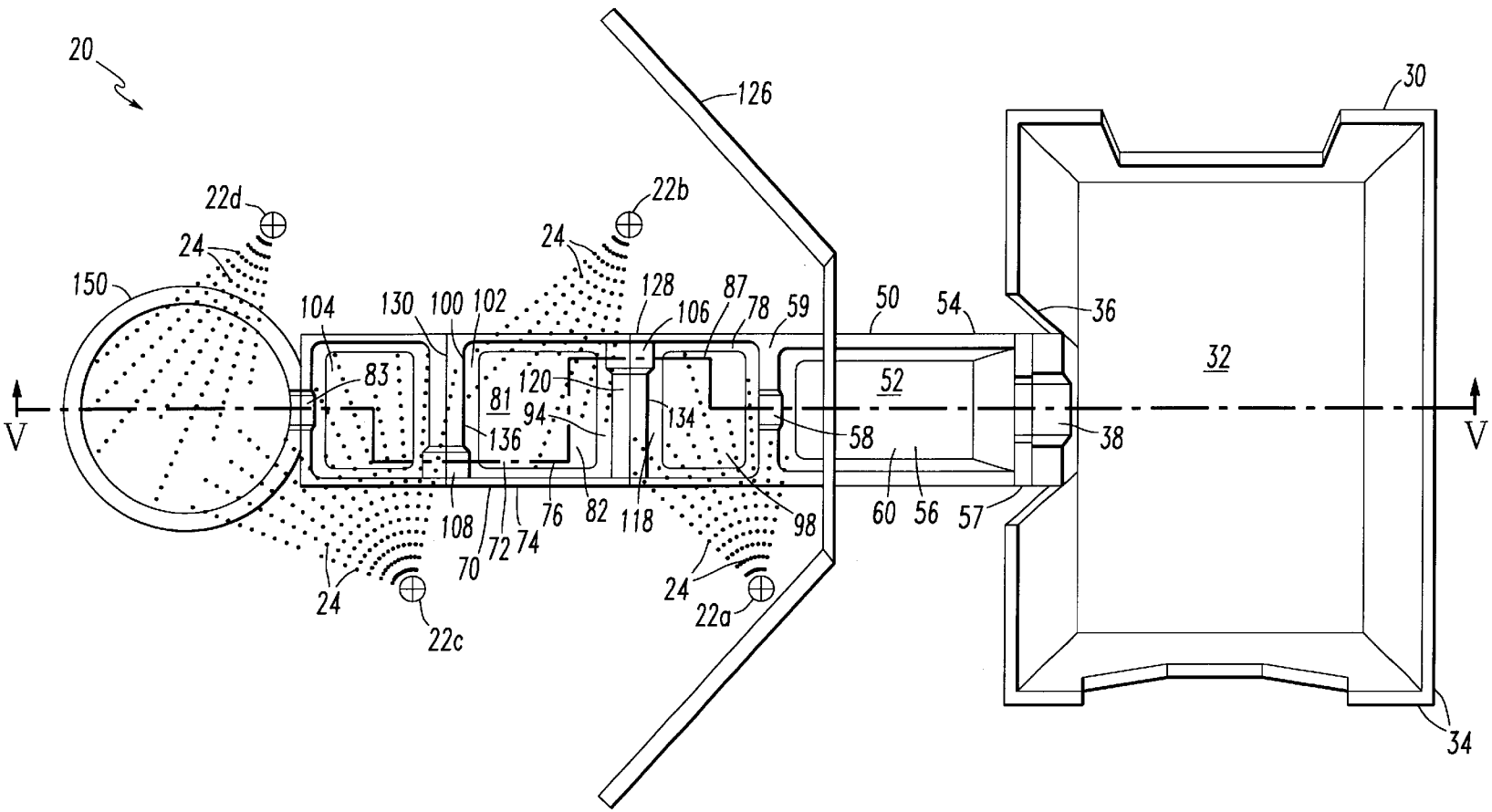
FIG. 4 is a top view of another embodiment of the molten metal refining apparatus of the present invention.
Figure 5:
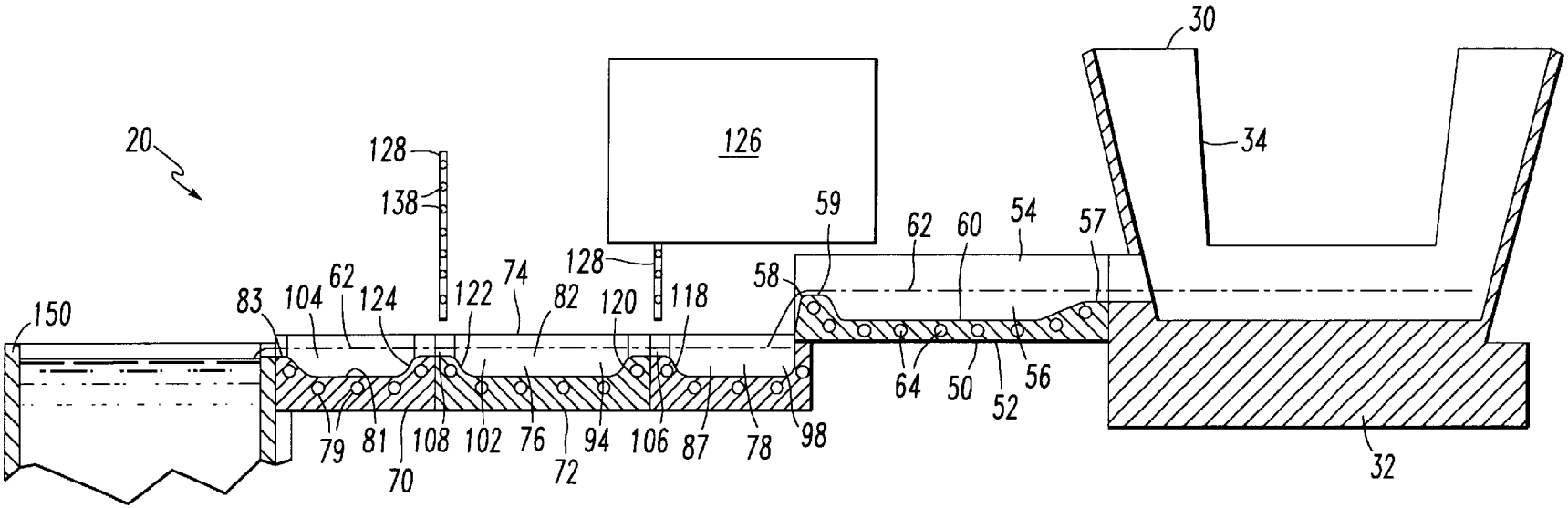
FIG. 5 is a cross-sectional view of the molten metal refining apparatus of FIG. 4 containing a molten stream, taken along line V—V in FIG. 4.

FIGS. 4 and 5 illustrate a top view and a cross-sectional view, respectively, of another furnace arrangement of the present invention. The furnace of FIGS. 4 and 5 is essentially constructed in the same manner as the furnace described above and depicted in FIGS. 1–3, except for the differences described below. The hearth system 20 of this embodiment includes a refining hearth 70 that has three deep zones 78, 82 and 104 interconnected by offset flow notches 106 and 108. The flow notches 106 and 108 are formed in transverse barriers 112 and 114 that may be integrally formed in the refining hearth 70. The flow notches 106 and 108 are shallow areas that are narrower than the width of the transfer hearth 70. The flow notches 106 and 108 may furthermore be offset, one from another, to create non-linear flow through the deep zones 78, 82 and 104. In the flow notches 106 and 108, the molten stream 62 forms a shallow pool. Thus impurities, including those having a neutral density, are proximate to the surface of the metal stream when resident in the flow notches 106 and 108, making them susceptible to removal by sublimation, evaporation or dissolution. Higher energies than are applied to the deep zones 78, 82 and 104 may be applied at flow notches 106 and 108 to enhance neutral and low density impurity removal without sacrificing the effectiveness of deep zones 78, 82, 104 for high density impurity removal. Turbulence is created at the upstream and downstream facings of the flow notches 106 and 108, which creates beneficial mixing of the molten stream 62. The upstream and downstream sides of the flow notches 106 and 108 may include sloping surfaces to prevent damage to the refinement hearth 70 during the removal of hardened metal. For example, the first flow notch 106 may have a sloping surface 118 on its upstream side and a sloping surface 120 on its downstream side, and the second flow notch 108 may have a sloping surface 122 on its upstream side and a sloping surface 124 on its downstream side. The non-linear flow path created by the offset flow notches 106 and 108 provides additional turbulence to the stream that aids in the dissolution of inclusions and the removal of impurities in the stream. As can also be seen from FIGS. 4 and 5, this embodiment can also employ the barrier arrangement of the present invention to control undesirable spattering of material.

Thus, from the foregoing discussion, it is apparent that the present hearth solves many of the problems encountered by prior hearth systems employed in furnaces for refining metal. In particular, the subject invention may be advantageously adapted to refine and purify metal in a hearth with a reduced molten dwell time, while preventing molten metal from bypassing the purification process. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A furnace for refining metal, said furnace comprising:

a refining hearth defining a first deep zone having a depth, a second deep zone having a depth, and a shallow zone having a depth, said depth of said shallow zone being less than said depth of said first deep zone and said depth of said second deep zone;

a barrier wall positioned above said hearth; and at least one energy source mounted above said hearth.

2. The furnace of claim 1, wherein said refining hearth has at least one coolant passage therein.

3. The furnace of claim 1, wherein said energy source is an electron beam gun.

4. The furnace of claim 1, wherein said energy source is a plasma torch.

5. The furnace of claim 1, wherein said first deep zone has a bottom surface that is interconnected with a bottom surface of said first shallow zone by a first sloping surface and wherein said barrier wall is supported above said sloping surface adjacent where said first sloping surface meets said bottom surface of said shallow zone.

6. The furnace of claim 1, wherein said barrier wall is fabricated from copper.

7. The furnace of claim 1, wherein said barrier wall has at least one coolant passage therein.

8. The furnace of claim 1, further including a main hearth communicating with said refining hearth.

9. The furnace of claim 8, wherein said main hearth further comprises a lip extending across at least a portion of an area wherein said main hearth adjoins said refining hearth.

10. The furnace of claim 8, wherein said main hearth has a bottom extending along a first plane and wherein said first deep zone has a bottom that extends along a second plane that is below said first plane.

11. The furnace of claim 1, wherein said refining hearth has a third deep zone that is interconnected to said second deep zone by a second shallow zone.

12. The furnace of claim 11, wherein said first deep zone, said first shallow zone, said second deep zone, said second shallow zone and said third deep zone define a non-linear flow path for the metal.

13. The furnace of claim 8, further comprising a transfer hearth extending between said main hearth and said refining hearth.

14. The furnace of claim 13, wherein said transfer hearth further comprises a raised lip on an outlet of said transfer hearth.

15. The furnace of claim 13, wherein said refining hearth has a bottom surface and wherein said transfer hearth has a bottom surface, said bottom surface of said refining hearth extending along a first plane that is substantially below a second plane along which said bottom surface of said transfer hearth extends.

16. A hearth, comprising an open vessel having a width, said open vessel defining:

a first deep zone having a first depth;

a second deep zone having a second depth;

a third deep zone having a third depth;

a first shallow zone intermediate said first deep zone and said second deep zone, said first shallow zone having a depth less than that of said first deep zone and less than that of said second deep zone; and a second shallow zone intermediate said second deep zone and said third deep zone, said second shallow zone having a depth less than that of said second deep zone and less than that of said third deep zone.

17. The hearth of claim 16, wherein said vessel includes a sloping surface intermediate said first deep zone and said shallow zone.

18. The hearth of claim 16, wherein said vessel includes a sloping surface intermediate said shallow zone and said second deep zone.

19. The hearth of claim 16, wherein said vessel further defines a sloping inlet surface adjacent said first deep zone.

20. The hearth of claim 16, wherein said open vessel has a cross-sectional area through which at least one coolant-receiving flow passage extends.

21. The hearth of claim 16, wherein said first deep zone has a bottom surface and wherein said shallow zone has a bottom surface and wherein said second deep zone has a bottom surface, said bottom surface of said first deep zone being interconnected to said bottom surface of said shallow zone by a first sloping surface and said bottom surface of said second deep zone interconnected with said bottom of said shallow zone by a second sloping surface.

22. The hearth of claim 21, wherein said open vessel has a cross-sectional area and wherein said hearth further comprises at least one coolant passage in said cross-sectional area.

23. The hearth of claim 22, wherein at least one said coolant passage is oriented adjacent said bottom surface of said first deep zone, said first sloping surface, said bottom surface of said shallow zone, said second sloping surface and said bottom surface of said second deep zone.

24. The hearth of claim 16, wherein said vessel is fabricated from copper.

25. The hearth of claim 16, wherein said vessel has a width and said shallow zone defines a flow notch having a width less than the width of said vessel.

26. The hearth of claim 16, wherein said open vessel has a width and wherein said first shallow zone defines a first flow notch having a first width less than said width of said open vessel, said second shallow zone defines a second flow notch having a second width less than the width of said open vessel, and said first flow notch is offset from said second flow notch.

27. The hearth of claim 26, wherein said vessel has a length that defines a pathway along which a molten stream is directed, said pathway having a width, said first flow notch reducing said width of the molten stream flow pathway to direct the molten stream away from said second flow notch.

28. The hearth of claim 26, wherein said vessel has a first side and a second side spaced away from said first side and said first flow notch is located adjacent said first side and said second flow notch is located adjacent said second side.

29. A hearth comprising:

a first deep pool;

a second deep pool aligned with said first pool;

a first shallow pool interconnecting said first and second deep pools, said first shallow pool having a depth that is less than depths of said first and second deep pools;

a third deep pool aligned with said first and second deep pools along a longitudinal axis; and a second shallow pool interconnecting said second and third deep pools, wherein said second shallow pool is not coaxially aligned with said first shallow pool about said longitudinal axis.

30. A furnace for refining metal, said furnace comprising a refining hearth defining a first deep zone having a depth, a second deep zone having a depth, a third deep zone having a depth, a first shallow zone between said first deep zone and said second deep zone and having a depth that is less than the depth of said first deep zone and less than the depth of said second deep zone, and a second shallow zone between said second deep zone and said third deep zone, said second shallow zone having a depth that is less than the depth of said second deep zone and less than the depth of said third deep zone.

31. A hearth comprising an open vessel, said open vessel defining:

a first deep zone having a first depth and a width;

a second deep zone having a second depth; and a shallow zone intermediate said first deep zone and said second deep zone, said shallow zone having a depth less than said first depth and less than said second depth, said shallow zone having a width substantially equal to said width of said first deep zone.

32. The hearth of claim 31, wherein said first depth and said second depth are substantially equal.

33. The hearth of claim 31, wherein said vessel includes at least one of:

a sloping surface intermediate said first deep zone and said shallow zone;

a sloping surface intermediate said shallow zone and said second deep zone; and a sloping inlet surface adjacent said first deep zone.

34. The hearth of claim 31, wherein said first deep zone has a bottom surface, said shallow zone has a bottom surface, and said second deep zone has a bottom surface, said bottom of said first deep zone being interconnected to said bottom surface of said shallow zone by a first sloping surface, and said bottom surface of said second deep zone being interconnected to said bottom surface of said shallow zone by a second sloping surface.

35. The hearth of claim 31, wherein said open vessel defines a third deep zone being separated from said second deep zone by a second shallow zone.

36. A furnace for refining metal, said furnace comprising:

a refining hearth including an open vessel, said open vessel defining a first deep zone having a first depth and a width, a second deep zone having a second depth, and a shallow zone intermediate said first deep zone and said second deep zone, said shallow zone having a depth less than said first depth and less than said second depth, said shallow zone having a width substantially equal to said width of said first deep zone; and at least one energy source mounted above said hearth.

37. A hearth comprising an open vessel, said open vessel defining:

a first deep zone having a bottom surface;

a second deep zone having a bottom surface; and a shallow zone having a bottom surface, said shallow zone intermediate said first deep zone and said second deep zone, said bottom surface of said first deep zone and said bottom of said second deep zone being in fixed positions and immovable relative to said bottom surface of said shallow zone, said bottom surface of said first deep zone being interconnected to said bottom surface of said shallow zone by a first sloping surface, and said bottom surface of said second deep zone being interconnected to said shallow zone by a second sloping surface.

38. The hearth of claim 37, wherein said vessel further defines a sloping inlet surface adjacent said first deep zone.

39. The hearth of claim 37, wherein said vessel has a width and said shallow zone defines a flow notch having a width less than said width of said vessel.

40. The hearth of claim 37, further comprising a third deep zone being separated from said second deep zone by a second shallow zone.

41. A furnace for refining metal, said furnace comprising:

an open vessel, said open vessel defining a first deep zone having a bottom surface, a second deep zone having a bottom surface, and a shallow zone having a bottom surface and intermediate said first deep zone and said second deep zone, said bottom surface of said first deep zone and said bottom surface of said second deep zone being in fixed positions and immovable relative to said bottom surface of said shallow zone, said bottom surface of said first deep zone interconnected to said bottom surface of said shallow zone by a first sloping surface, and said bottom surface of said second deep zone interconnected to said bottom surface of shallow zone by a second sloping surface; and at least one energy source mounted above said hearth.

* * * * *